US012188331B1

(12) United States Patent
Maher et al.

(10) Patent No.: US 12,188,331 B1
(45) Date of Patent: Jan. 7, 2025

(54) SELECTIVE USE DOWNHOLE MAGNET FOR DEBRIS COLLECTION

(71) Applicant: Halliburton Energy Services, Inc., Houston, TX (US)

(72) Inventors: Peter Reid Maher, Lafayette, LA (US); Brittany Morgan Emerson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/232,971

(22) Filed: Aug. 11, 2023

(51) Int. Cl.
*E21B 37/00* (2006.01)

(52) U.S. Cl.
CPC ..... *E21B 37/00* (2013.01)

(58) Field of Classification Search
CPC ..... E21B 31/06; E21B 37/00
See application file for complete search history.

(56) References Cited

U.S. PATENT DOCUMENTS

| | | | | |
|---|---|---|---|---|
| 1,487,721 | A | 11/1922 | Clayton | |
| 6,655,462 | B1 * | 12/2003 | Carmichael | B08B 9/0553 166/99 |
| 7,735,547 | B2 * | 6/2010 | Telfer | E21B 37/00 166/173 |
| 8,297,367 | B2 | 10/2012 | Chen et al. | |
| 9,260,941 | B2 * | 2/2016 | Linklater | E21B 37/00 |
| 9,863,217 | B2 * | 1/2018 | Cooper | E21B 31/06 |
| 10,208,553 | B2 * | 2/2019 | Sullivan | E21B 31/06 |
| 11,480,032 | B2 * | 10/2022 | Garcia | E21B 31/06 |
| 2007/0267196 | A1 * | 11/2007 | Mondelli | E21B 31/06 166/99 |
| 2008/0196881 | A1 * | 8/2008 | Telfer | E21B 37/00 166/70 |
| 2013/0000884 | A1 * | 1/2013 | Linklater | E21B 37/00 166/66.5 |
| 2015/0122480 | A1 * | 5/2015 | Sullivan | E21B 31/06 166/66.5 |

(Continued)

FOREIGN PATENT DOCUMENTS

WO 2007136667 A1 11/2007

OTHER PUBLICATIONS

Foreign Communication from Related Application—International Search Report and Written Opinion of the International Searching Authority, International Application No. PCT/US2023/030609, dated May 1, 2024, 10 pages.

(Continued)

*Primary Examiner* — Jennifer H Gay
(74) *Attorney, Agent, or Firm* — Conley Rose, P.C.; Rodney B. Carroll

(57) ABSTRACT

A magnetic wellbore cleaning tool with one or more rows of magnets located in corresponding grooves on the tool mandrel. A window sleeve rotationally coupled to the mandrel with one or more windows configured to be selectively positioned in a closed or open configuration. The window sleeve can block the magnet flux of the one or more rows of magnets on the mandrel in the closed configuration. The one or more windows can align with corresponding magnets to gather debris from the wellbore in the open configuration. A signal from surface can activate a sleeve actuator to selectively position the one or more longitudinal windows in a closed position or an open position.

20 Claims, 6 Drawing Sheets

(56) References Cited

U.S. PATENT DOCUMENTS

| | | | | |
|---|---|---|---|---|
| 2015/0192000 | A1* | 7/2015 | Cooper | E21B 31/06 166/243 |
| 2021/0246762 | A1* | 8/2021 | Paton | E21B 31/06 |
| 2021/0270108 | A1* | 9/2021 | Garcia | E21B 37/00 |
| 2021/0285301 | A1* | 9/2021 | Maher | E21B 31/06 |
| 2021/0372220 | A1* | 12/2021 | Garcia | H01F 7/0257 |
| 2023/0332486 | A1* | 10/2023 | Alkuhaili | E21B 37/02 |

OTHER PUBLICATIONS

Miswaco, Specialized Tools & Filtration, Version 5. 2012. p. 29, SMC. 1900.1203.R3 (E) Digital in U.S.A.

* cited by examiner

SELECTIVE USE DOWNHOLE MAGNET FOR DEBRIS COLLECTION

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Hydrocarbons, such as oil and gas, are commonly obtained from subterranean formations that may be located onshore or offshore. The construction of a hydrocarbon producing well can comprise a series of construction steps designed to extract hydrocarbons efficiently and safely. The process typically begins with the selection of a drilling location based on geological studies and seismic data analysis. Once the drilling site is identified, a drilling rig is mobilized to the location.

The drilling operation commences with the drilling of the wellbore, which involves the use of a drill bit attached to the bottom of a drill string. The drill string is typically rotated, and a drilling mud, e.g., a combination of water, weighting materials, and additives, is circulated down the drill string and back up the annular space between the drill string and the wellbore walls. This process serves multiple purposes, including cooling and lubricating the drill bit, stabilizing the wellbore, and carrying rock cuttings to the surface.

Once the desired depth is reached, the drilling phase of the wellbore construction process is completed, and the wellbore can be isolated from wellbore fluids. A primary cementing operation comprises the installation of casing, also referred to as a casing string, which consists of metal tubulars, e.g., steel pipes, coupled together, placed into the wellbore, and cemented in place. The cementing operation can place a cement slurry tailored for the wellbore environment within an annular space between the casing and the wellbore. The cemented casing string provides structural integrity, prevents well collapse, and isolates different geological formations to ensure the flow of hydrocarbons from the target zone. The cementing operation can comprise multiple strings of casing extending from a previous casing string. For example, a bottom of a first casing string, e.g., a float shoe, can be drilled out to extend the wellbore past the first casing string. A second casing string can be installed through the first casing string by a second cementing operation. Likewise additional casing strings, e.g., a third and fourth casing strings, can be installed through each subsequent casing string.

During a completion stage, various completion equipment can be installed into the wellbore and the casing string can be opened to couple the wellbore to a target production zone, e.g., hydrocarbon bearing reservoir. However, before the completion equipment is installed, a wellbore cleaning operation can clean the inner surface of the casing and replace the drilling fluids, e.g., drilling mud, present in the wellbore with a completion fluid such as brine. The cleaning operation serves to remove solids adhered to the wall of the casing or liner, e.g., the inner surface, to circulate residual drilling mud and other fluids out of the wellbore, and to filter out solids present in the wellbore fluid. A considerable amount of debris in the wellbore and on the inner surface of the casing/liner comprises rust particles, metal chips, drilled out equipment, or scrapings originating from equipment utilized during the construction process.

Various types of cleaning tools are known, one of which is generically referred to as a magnet sub. Tools of this type typically incorporate magnets designed to collect metallic particles or ferrous debris from the interior of the casing. In some scenarios, it may be advantageous to turn-off, disable, or negate the magnetic flux from the magnets, for example, to clean at a target depth. A method to selectively enable a magnetic sub in a downhole location is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
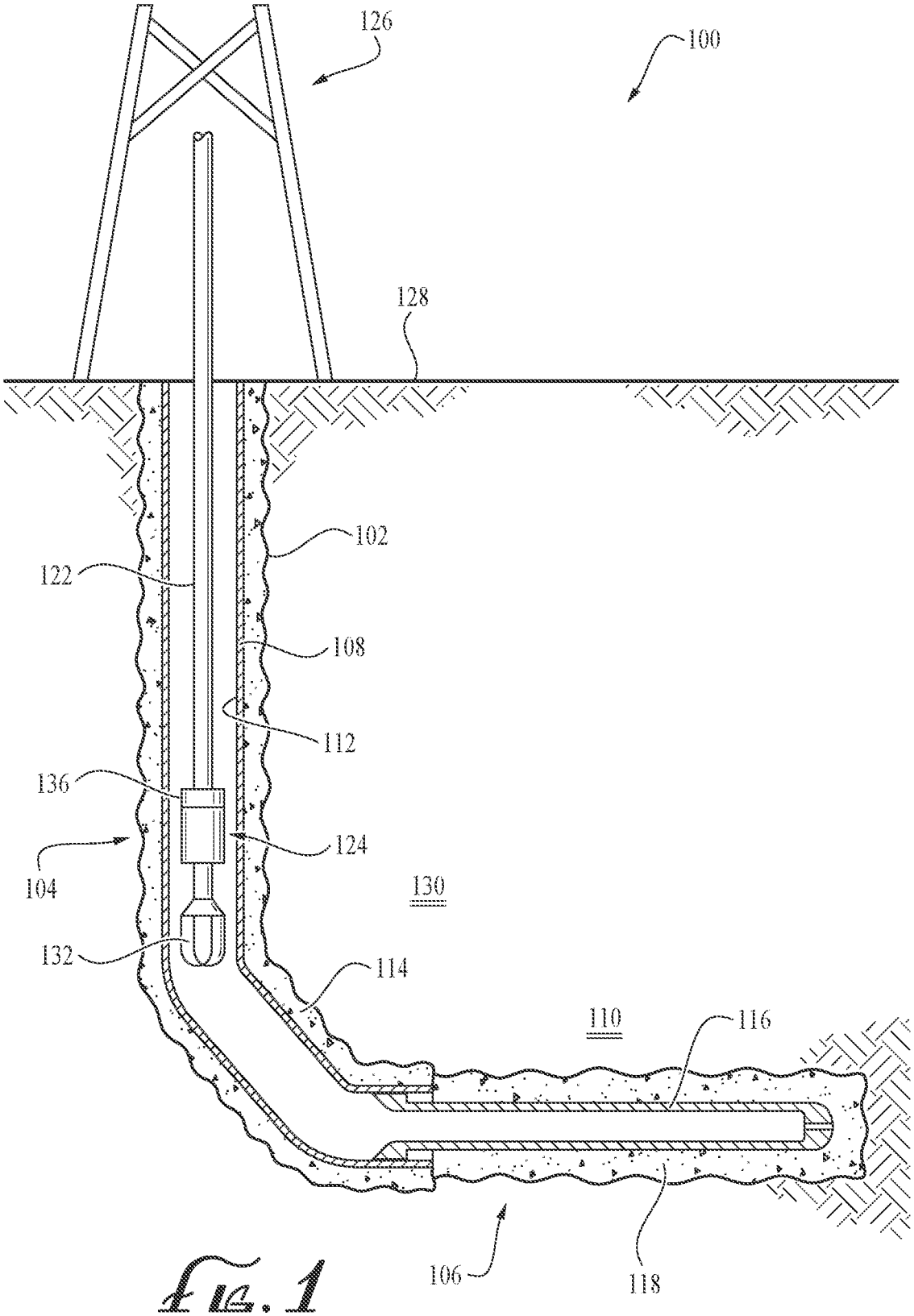
FIG. 1 is a diagram illustrating an exemplary environment for a wellbore cleaning operation according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

As used herein, orientation terms "uphole," "downhole," "up," and "down" are defined relative to the location of the earth's surface relative to the subterranean formation. "Down" and "downhole" are directed opposite of or away from the earth's surface, towards the subterranean formation. "Up" and "uphole" are directed in the direction of the earth's surface, away from the subterranean formation or a source of well fluid. "Fluidically coupled" means that two or more components have communicating internal passageways through which fluid, if present, can flow. A first component and a second component may be "fluidically coupled" via a third component located between the first component and the second component if the first component has internal passageway(s) that communicates with internal passageway(s) of the third component, and if the same internal passageway(s) of the third component communicates with internal passageway(s) of the second component.

Hydrocarbons, such as oil and gas, are produced or obtained from subterranean reservoir formations that may be located onshore or offshore. The development of subterranean operations and the processes involved in removing hydrocarbons from a subterranean formation typically involve a number of construction steps such as drilling a wellbore at a desired well site, isolating the wellbore with a barrier material, completing the wellbore with various production equipment, treating the wellbore to optimize production of hydrocarbons, and providing surface production equipment for the recovery of hydrocarbons from the wellhead.

Prior to the completion operations, a cleanout operation can remove drilling mud and debris from a wellbore. The cleanout operation may include a cleanout string, e.g., one or more cleanout tools, conveyed into a wellbore to a target depth, for example, the bottom or toe of the wellbore. The cleanout string can include one or more cleanout tools configured to remove debris, for example, a service packer, a casing scraper, a casing brush, a circulating valve, a downhole fluid filter, a magnet tool, a junk basket, a well screen, a milling shoe, or combinations thereof. The cleanout string can be conveyed on a workstring configured to circulate fluid into the wellbore to clean and/or replace the wellbore fluids.

Typically, a magnet tool comprises a plurality of magnets extending from a mandrel to generate or project a magnet flux into the wellbore. The magnets may be of any common shape, for example, a button, a cube, a bar, a torus, or any other geometric shape. Typically, a bar magnet can be manufactured with a generally rectangular cross-section. The plurality bar magnets can be positioned along a longitudinal direction of an outer surface of the mandrel. The magnet tool is typically conveyed into the wellbore on drill pipe, tubing, coil tubing, or any other suitable tubular.

The cleanout operation may target a portion of the wellbore for cleaning, for example, within a second casing string of the wellbore or adjacent to a formation. The cleanout string may be disabled, or configured to not clean, during the conveyance to the target cleaning location. However, the magnetic flux from bar magnets on the magnet sub is continually generated and projected into the wellbore and thus continually collects debris during conveyance. A method of disabling or cancelling magnets is desirable.

In some embodiments, the cleanout string can include a magnet tool configured in a run-in position or disabled position. In the run-in position, the magnets, e.g., bar magnets, of the magnet tool can be covered to block and/or reduce the projection of the magnetic flux. The magnets can be activated, or configured to clean, by a signal from the surface, e.g., applied pressure. The magnet tool can clean the inner surface of the wellbore along the target zone or along a portion of the longitudinal distance of the wellbore. In some embodiments, the magnet tool can be transitioned from the activated position back to the run-in position. For example, the magnet tool can cover or return the magnets to the run-in position.

A surface activated magnet tool or selective magnet tool can provide a solution to cleaning a portion of the wellbore. In some embodiments, the selective magnet tool can comprise non-activated and activate magnets. For example, the selective magnet tool can be configured in a run-in position with the magnets, or plurality of magnets, covered to block or reduce the magnetic flux projected outwards or towards the inner surface of the casing. An activation mechanism can reconfigure the magnetic tool to an activated configuration by uncovering or exposing the plurality of magnets to project the magnetic flux into an annulus defined as the area the outer surface of the magnetic tool and the inner surface of the casing. The selective magnetic tool can be activated or said another way, reconfigured from a first configuration, e.g., run-in configuration to a second configuration, e.g., active configuration. A surface signal, e.g., pressure or flowrate, can activate or initiate the activation mechanism. In some embodiments, the selective magnetic tool can be reconfigured from a second configuration to a third configuration. For example, the selective magnetic tool can be reconfigured from an active configuration to the run-in configuration.

Turning now to FIG. 1, an exemplary wellsite environment 100 for a cleanout operation is illustrated. In some embodiments, wellsite environment 100 comprises a wellbore 102 extending from a surface location to a permeable subterranean formation 110. The wellbore 102 can be drilled through a subterranean formation 130 from surface location 128 using any suitable drilling technique. The wellbore 102 can include a substantially vertical portion 104 that transitions to a deviated portion and into a substantially horizontal portion 106. In some embodiments, the wellbore 102 may comprise a nonconventional, horizontal, deviated, multilateral, or any other type of wellbore. Wellbore 102 may be defined in part by a casing string 108 that may extend from a surface location to a selected downhole location. The casing string 108 may be isolated from the wellbore 102 by cement 114. Portions of wellbore 102 that do not comprise the casing string 108 may be referred to as open hole. Although the horizontal portion 106 is illustrated with a liner string 116, e.g., secondary casing, and cement 118, it is understood that the horizontal section can include an open hole section, an open hole completion, a liner string, a cement section, or combinations thereof. While the wellsite environment 100 illustrates a land-based subterranean environment, the present disclosure contemplates any wellsite environment including a subsea environment. In one or more embodiments, any one or more components or elements may be used with subterranean operations with equipment located on service platforms 126, offshore platforms, drill ships, semi-submersibles, drilling barges, and land-based rigs.

A cleanout string 124 may be conveyed into the wellbore 102 by a workstring 122 extending from a service platform 126. The workstring 122 can be any piping, tubular, or fluid conduit including, but not limited to, drill pipe, workover tubing, production tubing, casing, coiled tubing, and any combination thereof. The workstring 122 can provide a conduit the cleaning operation to deliver fluids to the cleanout string 124 or extract fluids from the interior of the casing string 108 as will be described further herein.

In some embodiments, the cleanout string 124 can include a drill bit 132 or milling shoe. The cleanout string 124 can be conveyed into the wellbore 102 and/or casing string 108 to drill out or remove one or more completion tools, for example, a frac plug. The drill bit 132 can locate and/or contact the completion tool and the workstring 122 can be rotated to drill out or remove the completion tool. Drilling fluid or completion fluid can be pumped down the workstring 122 during the drilling operation to lift out or remove the cuttings from the interior of the casing string 108.

In some embodiments, the cleanout string 124 comprises a wellbore cleaning tool with a magnetic flux. A selective magnetic tool 136, e.g., the wellbore cleaning tool with a magnetic flux, can be conveyed into the wellbore 102 and/or casing string 108 on the workstring 122 alone or as a part of the cleanout string 124. Said another way, the cleanout string 124 can comprise the selective magnetic tool 136 alone or with other downhole tools, e.g., a junk basket. In some embodiments, the selective magnetic tool 136 can be configured in a run-in position with one or more rows of magnets covered or isolated from the annulus. An activation mechanism, also referred to as a sleeve actuator, can reconfigure the selective magnet tool 136 to an activated configuration by uncovering and/or exposing the one or more rows of magnets to the annulus. In some embodiments, the selective magnet tool 136 can be reconfigured from a second configuration, e.g., an active configuration, to a third configuration, e.g., the run-in configuration. For example, the cleanout string 124 can be conveyed into the casing string 108 to locate, e.g., contact, a completion tool or cementing tool within the wellbore 102. The selective magnetic tool 136 can be activated from surface by reconfiguring the selective magnetic tool 136 from a run-in position to an active position, e.g., magnets exposed to the annulus formed between the outer surface of the cleanout string 124 and the inner surface 112 of the casing string 108.

In some embodiments, the cleanout string 124 can include more than one selective magnet tool 136. For example, the cleanout string 124 can comprise 1, 2, 3, 4, 5, 6, 7, 8, 9, 10, or any number of selective magnet tools 136. In some embodiments, the two or more selective magnet tools 136 can be activated or reconfigured to the active position at a predetermined value. For example, the cleanout string 124 can include three selective magnet tools 136A, 136B, and 136C. At a predetermined value, e.g., applied pressure, the activation mechanisms of selective magnet tools 136A, 136B, and 136C can activate the selective magnet tools at approximately the same time or same predetermined value. In some embodiments, the two or more selective magnet tools 136 can be activated or reconfigured at different predetermined values, e.g., different depths. For example, the activation mechanism of selective magnet tool 136A can open at a first depth (vertical depth measured from surface), the activation mechanism of selective magnet tool 136B can open at a second depth (e.g., a greater vertical depth than first depth), and the selective magnet tool 136C can activate at a third depth that is greater vertical depth than the second depth. Likewise, two or more selective magnet tools 136 can open at each of the predetermined depths, e.g., the second depth.

Turning now to FIG. 2, a partial cross-sectional view of a selectable magnet tool can be described. In some embodiments, a selectable magnet tool 200 can be an embodiment of the selective magnet tool 136 shown in FIG. 1. The selectable magnet tool 200 comprises a tool mandrel 210, a window sleeve 212, and a sleeve actuator 214. The tool mandrel 210 comprises one or more rows of magnets 216 installed in a recessed groove 218. The window sleeve 212 is configured to selectively i) cover or ii) reveal the rows of magnets 216. The sleeve actuator 214 can control or direct the window sleeve 212 to change from a first position, e.g., cover, to a second position, e.g., reveal.

Figure 2A:
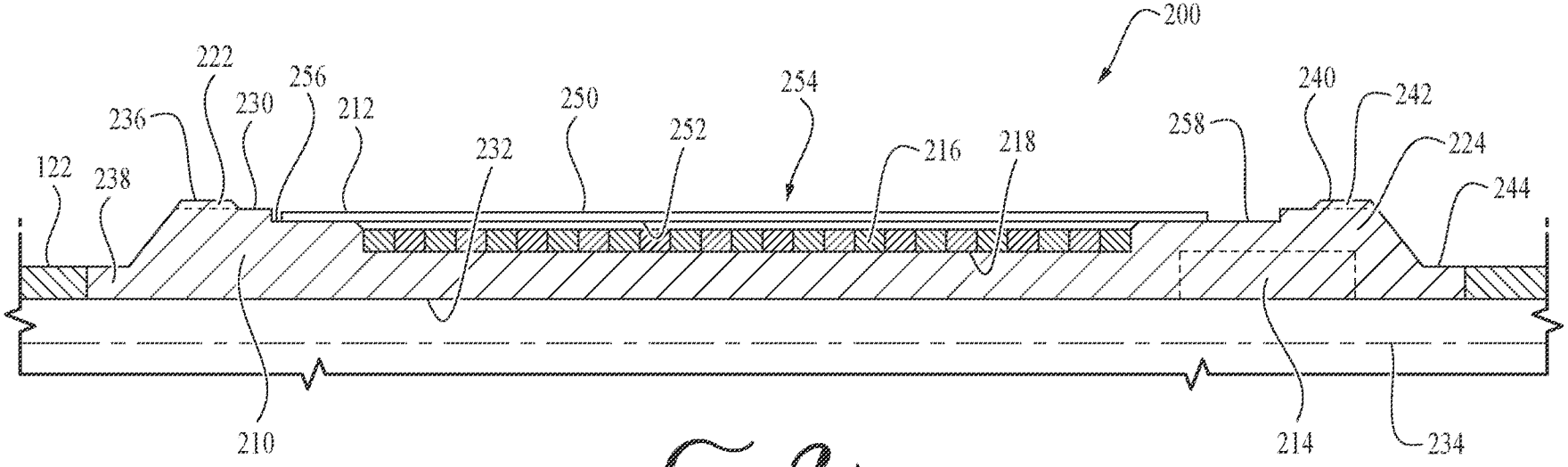
FIG. 2A is a cross-sectional view of a selectable magnet tool according to an embodiment of the disclosure.
Figure 2B:
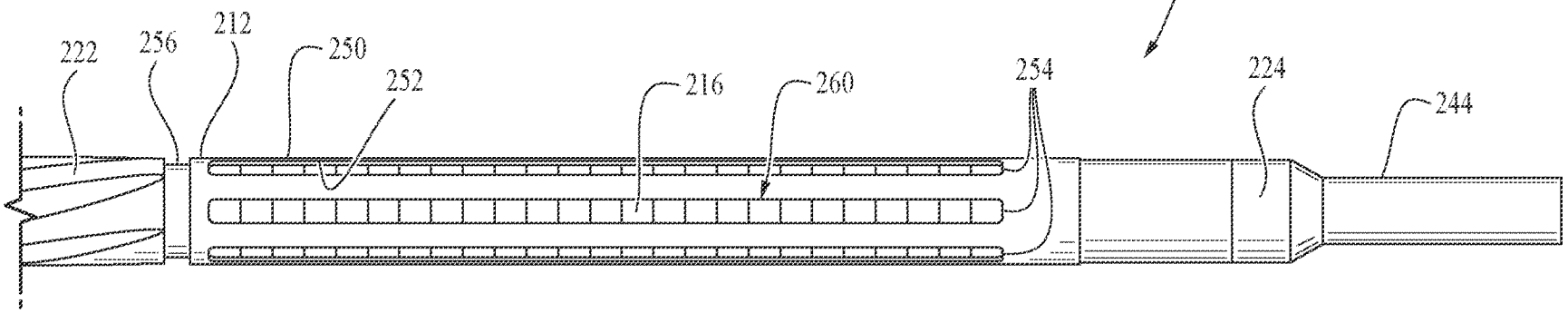
FIG. 2B is a side view of a selectable magnet tool according to an embodiment of the disclosure.

In some embodiments, the tool mandrel 210 is generally cylinder shape with an outer surface 230, an inner surface 232, and one or more grooves 218. The inner surface 232 can define a flow passage through the tool. Each of the one or more recessed groove 218 can include a generally rectangular cross-sectional shape positioned longitudinally parallel to the central axis 234 of the tool mandrel 210. The recessed groove 218 may be referred to as a longitudinal groove. The tool mandrel 210 can include a first stabilizer 222 and an end sub 224. The first stabilizer 222 can be generally cylinder in shape with an outer surface 236, a fluid passage, and an uphole end 238. The outer surface 236 of the first stabilizer 222 can centralize or position the tool mandrel 210 a predetermined distance from the inner surface 112 of the casing string 108 and one or more fluid passages or grooves can allow wellbore fluids to pass across or through the stabilizer. The uphole end 238 can be releasably coupled to a workstring, e.g., workstring 122, the cleanout string 124, or a second selective magnet tool 200B. The second end sub 224 can be generally cylinder in shape with an outer surface 240, a fluid passage 242, and a downhole end 244. In some embodiments, the outer surface 240 of the end sub 224 can be the same general size or circumference as the outer surface 236 of the first stabilizer 222. The downhole end 244 can be releasably coupled to a portion of the workstring, the cleanout string 124, or another selective magnet tool 200C. The window sleeve 212 can be generally cylinder shape with an outer surface 250, an inner surface 252, and one or more longitudinal windows also referred to as window 254 as shown in FIG. 2B. The inner surface 252 of the window sleeve 212 can have a sliding fit onto an upper surface 256 on the first stabilizer 222 and a lower surface 258 on the end sub 224. In some embodiments, the window sleeve 212 can be configured to rotate about the first stabilizer 222 and the second stabilizer 228 from a first position, e.g., closed position, to a second position, e.g., open position. In some embodiments, the window sleeve 212 can be configured to rotate from a second position, e.g., open position, to a third position, e.g., a closed position.

In some embodiments, a plurality of magnets 216 can be arranged or positioned into a row of magnets or longitudinal arrangement of magnets. The magnets 216 can be generally rectangular in shape and may be made from a material that is magnetized and creates its own persistent magnetic field. A plurality of magnets 216 can be arranged or positioned end to end in a longitudinal row referred to as a magnet row 260. In an embodiment, the magnets 216 within the one or more magnet rows 260 may be permanent magnets formed, at least in part, from one or more ferromagnetic materials. Suitable ferromagnetic materials useful with the magnets described herein may include, but are not limited to, iron, cobalt, rare-earth metal alloys, ceramic magnets, alnico nickel-iron alloys, rare-earth magnets (e.g., a Neodymium magnet and/or a Samarium-cobalt magnet). Various materials useful with the magnets of the selective magnet tool 200 can include those known as Co-netic AA®, Mumetal®, Hipernon®, Hy-Mu-80®, Permalloy®, each of which comprises about 80% nickel, 15% iron, with the balance being copper, molybdenum, and/or chromium. Although the magnets 216 are described as generally rectangular in shape, it is understood that the magnets 216 can be any geometric shape with one or more cross-sectional shapes, for example, cubic, rod shape, cylinder shape, cuboid, rectangular bar, torus, sphere, plate shape, button shape, or any combination thereof and with cross-sectional shapes including round, semi-circle, triangular, square, parallelogram, trapezium, pentagon, hexagon, heptagon, octagon, nonagon, decagon, or any combination thereof.

In some embodiments, the magnets 216 within the one or more magnet rows 260 can be permanently coupled or releasably coupled to the tool mandrel 210. In one scenario, the magnets 216 can be permanently installed or formed within the recessed groove 218 of the tool mandrel 210. In another scenario, the magnets 216 can be releasably installed, e.g., releasably coupled, within the recessed groove 218, for example, with one or more fasteners. In some embodiments, the magnets 216 can be coupled or installed into a magnet carrier or tray (not shown). The magnet carrier can be releasably coupled to the recessed groove 218 of the tool mandrel 210. In some scenarios, one or more magnet row 260, e.g., a longitudinal arrangement of magnets 216, can be installed within corresponding longitudinal grooves, e.g., recessed groove 218, of the tool mandrel 210.

Figure 2D:
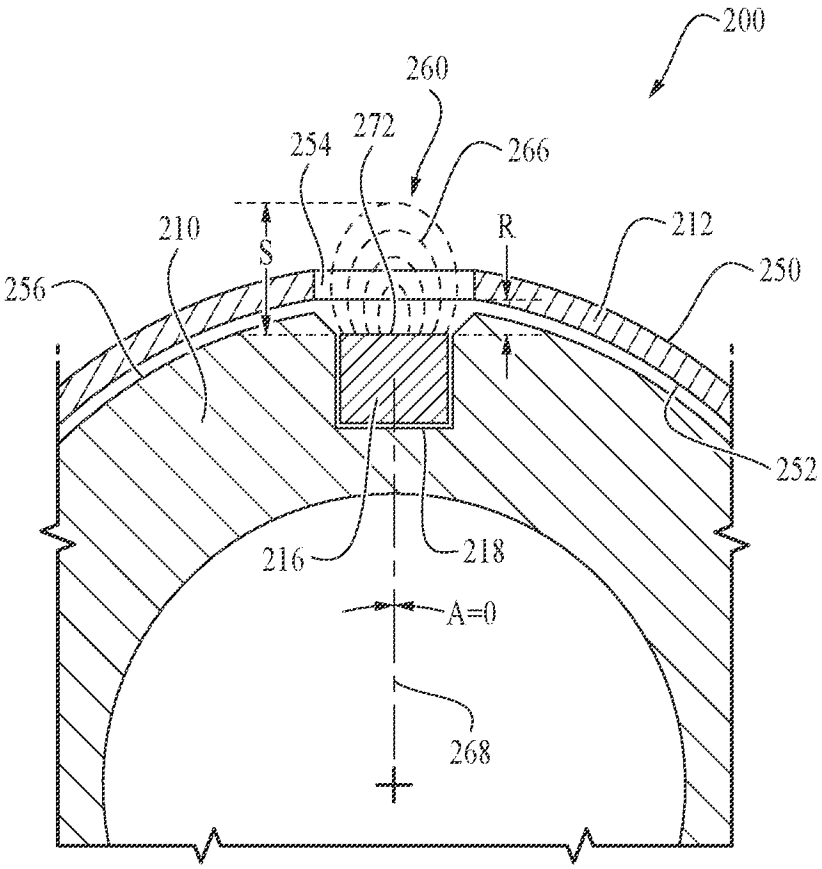
FIGS. 2C and 2D are cross-sectional end views of a selectable magnet tool according to an embodiment of the disclosure.
Figure 2C:
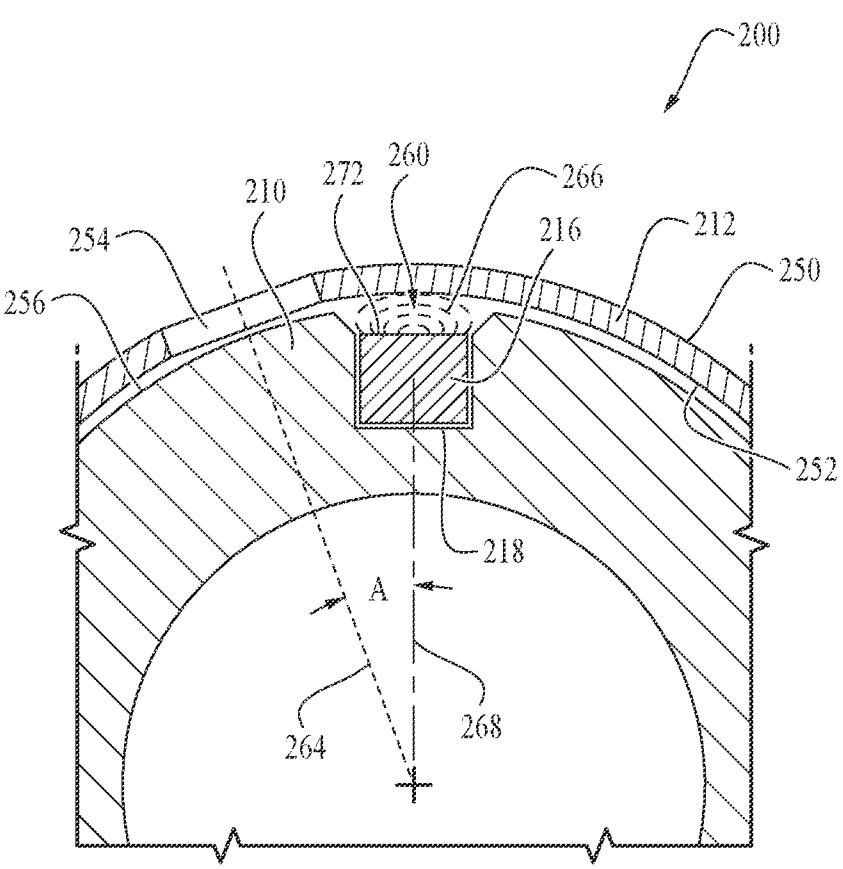

Turning now to FIG. 2C and FIG. 2D, a cross-sectional view of the selective magnet tool 200 can be described. In FIG. 2C, the window sleeve 212 can be in a first position, also referred to as a closed position, with the one or more longitudinal window, e.g., window 254, not aligned with the longitudinal groove, e.g., groove 218, nor the magnet row 260 within the groove 218. A centerline 264 of the window 254 can form an angle A with a centerline 268 of the groove 218 and/or magnet row 260. The window 254 in the run-in position can be rotated so that no part of the window 254 is partially aligned with the groove 218 and thus, the magnetic flux 266 projected by the plurality of magnets 216 is blocked or reduced by the window sleeve 212. In FIG. 2D, the window sleeve 212 can be rotated and/or translated to a second position, also referred to as an open position, with the window 254 aligned with the groove 218 and the magnet row 260 within the groove 218. The centerline 264 of the window 254 can be coincident or nearly coincident with the centerline 268 of the groove 218 and/or magnet row 260. The magnetic flux 266 generated by the magnets 216 can extend outwards past the window 254 in the window sleeve 212. In some embodiments, a radial distance "S" that the magnetic flux 266 extends or projects outwards from a top face 272 of the magnet 216 can be a function of the magnetic flux 266 and a radial distance "R" from the top face 272 of the magnet 216 to the inner surface 252 of the window sleeve 212. In some embodiments, the magnetic flux 266 does not extend past the window sleeve 212 in the closed position. In some embodiments, the magnetic flux 266 does not extend past the window sleeve 212 in the open position. In some embodiments, the magnetic flux 266 doesn't extend past the sleeve 212 in the closed position but does extend past the sleeve in the open position.

Figure 3A:
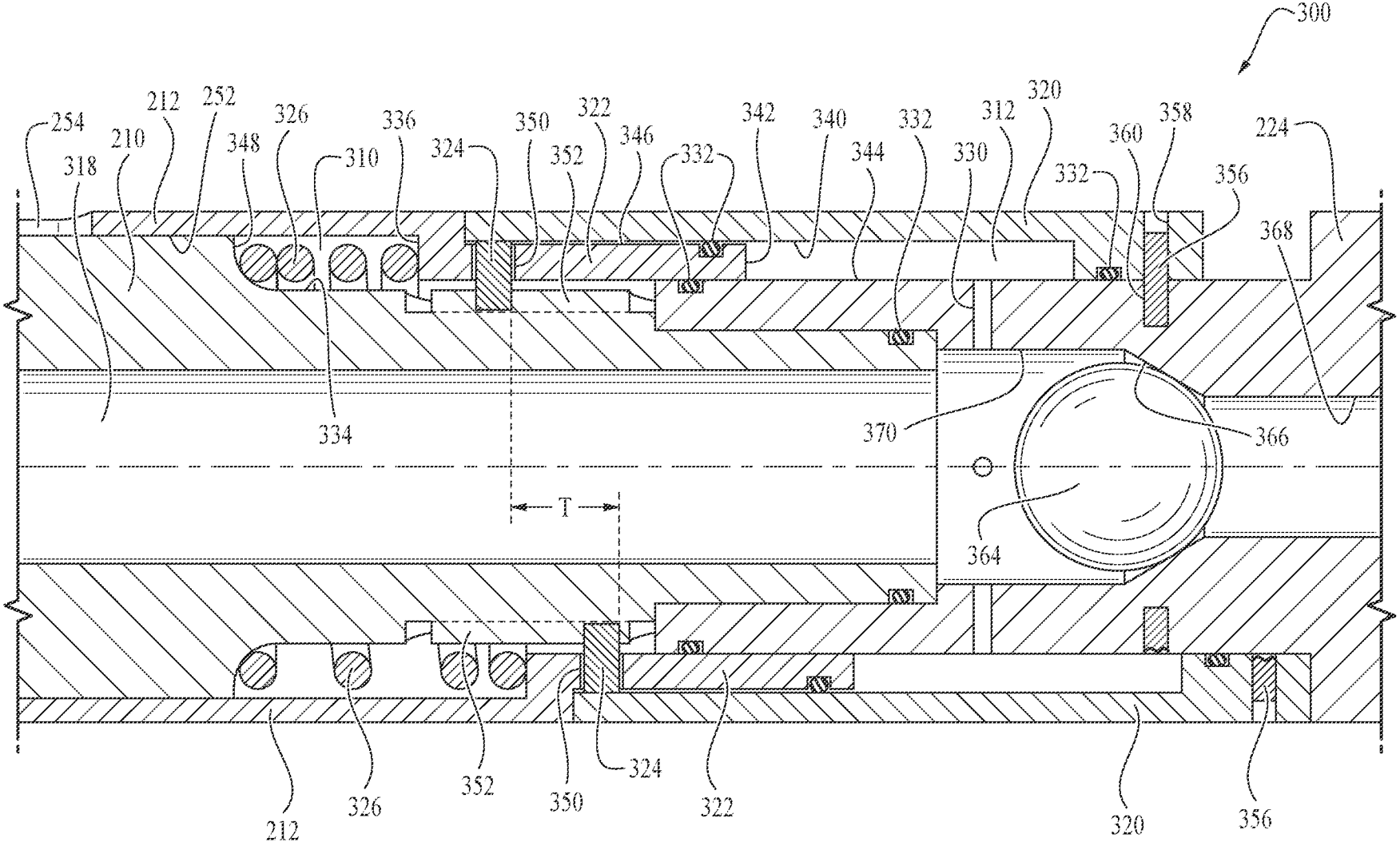
FIG. 3A is a partial cross-sectional view of an exemplary sleeve actuator according to an embodiment of the disclosure.

The window sleeve 212 can be actuated or transitioned from a first position to a second position by the sleeve actuator 214. Turning now to FIG. 3A, a partial cross-sectional view of an sleeve actuator can be described. The sleeve actuator 300 can be an embodiment of sleeve actuator 214. In some embodiments, the sleeve actuator 300 comprises a spring chamber 310, a release chamber 312, and a release device 314. The release chamber 312 can be formed by an inner surface 340 of a cylinder sleeve 320, a lower face 342 of a lug carrier 322, and an outer surface 344 of the end sub 224. The cylinder sleeve 320 can be slidingly engaged with an outer surface 346 of the lug carrier 322 and the outer surface 344 of the end sub 224. The release chamber 312 is fluidly connected to the fluid passage 318 by one or more fluid ports 330 and sealingly isolated from the annulus by seals 332, e.g., o-rings, in circumferential grooves on the cylinder sleeve 320, lug carrier 322, and end sub 224.

In some embodiments, the spring chamber 310 can be formed by an outer surface 334 of the tool mandrel 210, the inner surface 252 of the window sleeve 212, an upper face 336 of the lug carrier 322, and an end surface of the tool mandrel 210. In some embodiments, the window sleeve 212 can be coupled to the lug carrier 322. In some embodiments, the window sleeve 212 and the lug carrier 322 can be a single component with unitary construction. A spring 326 can abut a lower face 348 of the tool mandrel 210 and the upper face 336 of the lug carrier 322.

In some embodiments, one or more shear devices 356 can retain the sleeve actuator 300 in a first position, e.g., a run-in position. The run-in position is illustrated in FIG. 3A with the portion above the centerline. The one or more shear devices 356, e.g., shear pin, can be installed through a pin port 358 on the cylinder sleeve 320 and a retaining port 360 on the second stabilizer 224 to retain the cylinder sleeve 320 in the first position.

Figure 3B:
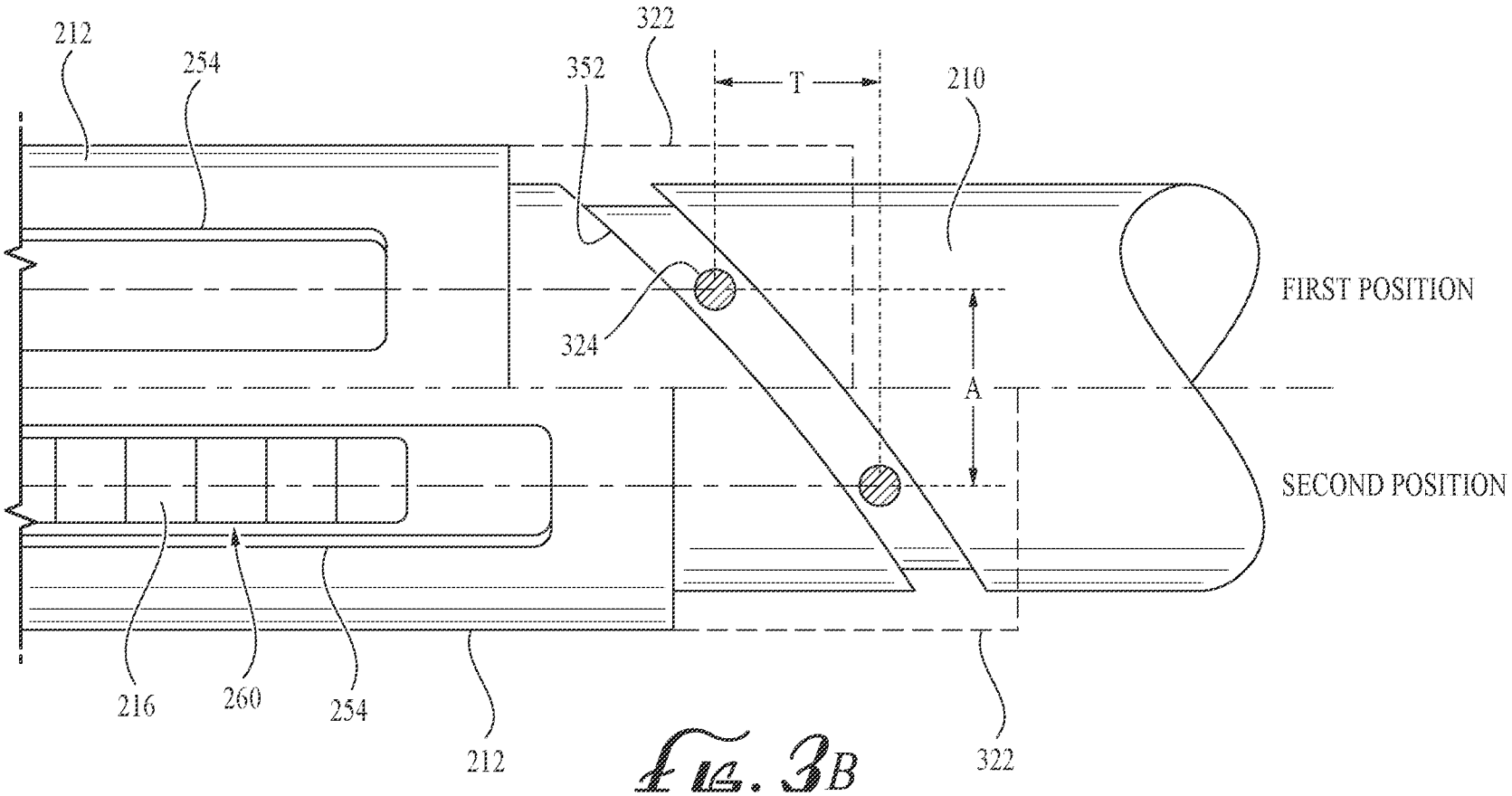
FIG. 3B is a side view of an exemplary sleeve actuator according to an embodiment of the disclosure.

The angular position of the window 254 in the window sleeve 212 relative to the magnet row 260 can be determined by helical grooves. Turning now to FIG. 3B, a partial cross-sectional side view of the helical groove can be described. In some embodiments, one or more lugs 324 can be positioned in a lug port 350 of the lug carrier 322 and retained by the inner surface 340 of the cylinder sleeve 320. The one or more lugs 324 can engage one or more helical grooves 352 located on the outer surface 334 of the tool mandrel 210. As the lug 324 travels within the helical groove 352, the lug 324 can rotate the one or more windows 254 and angular distance "A" as the lug 324 travels a linear distance "T". Although the lug 324 within the helical groove 352 is illustrated as rotating the window in a clockwise direction, it is understood that the helical groove 352 could be configured to rotate the window in a counter-clockwise direction. The one or more lugs 324 within the one or more helical grooves 352 can configure the window sleeve 212 in a first position, e.g. a closed position or run-in position, and a second position, e.g., an open position or active position.

The sleeve actuator 300 can be released by creating pressure differential with a fluid pressure within the release chamber 312 greater than the wellbore fluid pressure or the fluid pressure within the annulus. Returning to FIG. 3A, the release position is illustrated with the portion below the centerline. In some embodiments, the cleaning operation can selectively block the workstring 122 in a location below the fluid port 330 of the sleeve actuator 300 by the service personnel at surface. For example, a downhole tool can be conveyed into the workstring 122 to block the fluid passage below the sleeve actuator 300. The cleaning operation can pump fluid into the fluid passage 318 to increase the fluid pressure within the release chamber 312 above the hydrostatic pressure within the wellbore. The pressure differential applied to cross-sectional area of the cylinder sleeve 320 can generate a force to break the shear devices 356 and push the cylinder sleeve 320 to the second position also called the release position. The piston area can be defined as the inner surface of the cylinder sleeve 320 and the outer surface 344 of the second stabilizer 224. The spring 326 can bias the lug carrier 322 and the lug 324 to move with the cylinder sleeve 320 to the second position and thus rotate the window sleeve 212 by an angle "A".

Although the cleaning operation is described as selectively blocking the workstring 122, it is understood that the fluid passage 318 within the selective magnet tool 200 can be blocked. In some embodiments, a ball 364 can sealingly engage a ball seat 366 within the second stabilizer 224. In some embodiments, the ball seat 366 is formed with a second inner surface 368 being smaller in circumference than a first inner surface 370. In some embodiments, the ball seat 366 is a releasable ball seat with the second inner surface 368 being the same size, e.g., circumference, as the first inner surface 370. In some embodiments, the ball seat 366 is omitted and the second inner surface 368 is the same size, e.g., circumference, as the first inner surface 370. Although the workstring 122 is described as being blocked, it is understood that the sleeve actuator 300 can be configured to activate with pressure applied within the annulus or casing string 108 instead of with fluid pressure within the fluid passage 318.

Figure 4A:
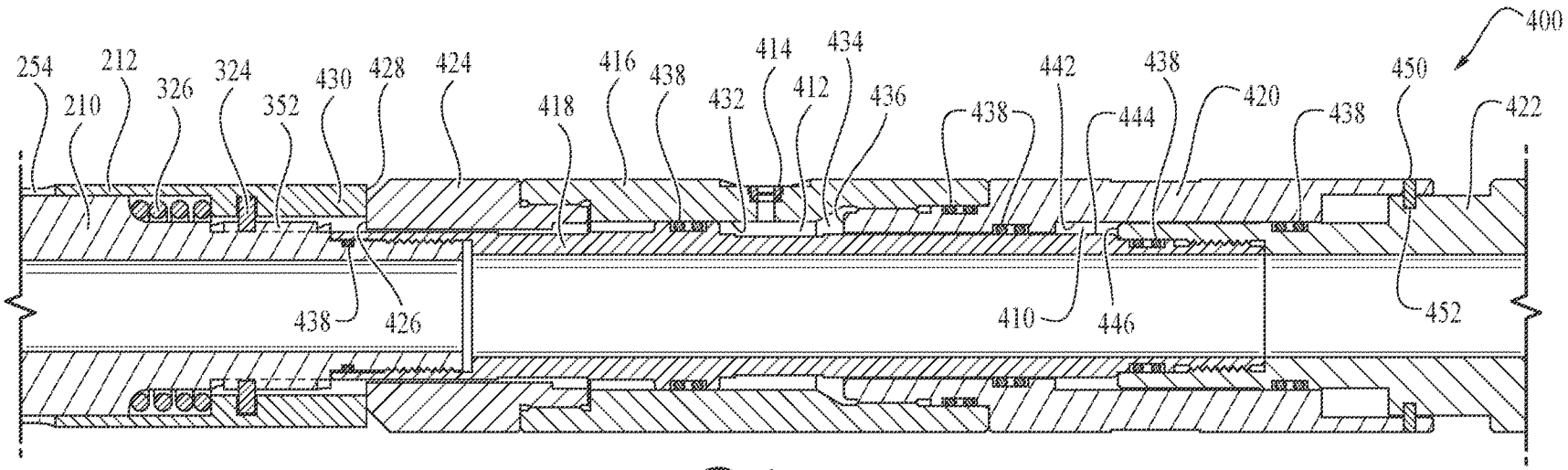
FIGS. 4A and 4B are a partial cross-sectional view of an exemplary sleeve actuator according to another embodiment of the disclosure.

The sleeve actuator 214 of the selective magnet tool 200 can be activated by hydrostatic pressure within the wellbore. The hydrostatic pressure adjacent to the cleanout tool string 124 will increase as the cleanout tool string 124 is conveyed into the wellbore 102. The sleeve actuator 214 can open and/or activate at a predetermined hydrostatic pressure value and/or a vertical depth value of the wellbore 102. Turning now to FIG. 4A, an actuation feature can be described. In some embodiments, an sleeve actuator 400 comprises an activation chamber 410, a release chamber 412, and a fluid stop 414. The release chamber 412 and activation chamber 410 can be filled with atmospheric pressure, e.g., air, with approximately equal cross-sectional piston areas to balance or prevent the movement of the sleeve actuator 214 from a first position, e.g., a run-in position.

The release chamber 412 can be formed by an inner surface 432 of an upper housing 416, an outer surface 434 of a lower mandrel 418, and an upper face 436 of a lower housing 420. The release chamber 412 can be isolated, e.g., sealed, from the hydrostatic pressure within the wellbore 102 by one or more seals 438 and a fluid stop 414. The fluid stop 414 can be a burst disk, also referred to as a rupture disc, that is configured to break or open at a predetermined differential pressure. Although the fluid stop 414 is described as a burst disk, it is understood that the fluid stop 414 can be any removable, shiftable, or breakable fluid barrier. For example, the fluid stop 414 can be a removable plug composed of a dissolvable or degradable material configured to be corroded with wellbore fluids. Although the fluid stop 414 is described as located on the upper housing 416 and isolating, e.g., sealing, the release chamber 412 from the annulus, it is understood that the fluid stop 414 can be located on the lower mandrel 418 and isolating the release chamber 412 from fluid pressure within the fluid passage 318.

The activation chamber 410 can be formed by an inner surface 442 of the lower housing 420, an outer surface 444 of the lower mandrel 418, and an end face 446 of an end sub 422. The activation chamber 410 can be isolated, e.g., sealed, from the hydrostatic pressure of the wellbore 102 by one or more seals 438. One or more shear pins 450 can be installed through corresponding pin ports in the lower housing 420 into a circumferential groove 452 in the end sub 422 to retain the sleeve actuator 400 in a first position or run-in position.

In some embodiments, the sleeve actuator 400 can position and/or retain a lug 324 in a first position within a helical groove 352 on the tool mandrel 210 until the fluid stop 414 is removed. A upper end face 426 of an end ring 424 coupled to the upper housing 416 can abut a lower end face 428 of a lug carrier 430 coupled to the window sleeve 212. As previously described in FIG. 3B, a lug 324 can rotationally and linearly translate a window sleeve 212 from a first position to a second position by traveling within the helical groove 352. The window sleeve 212 can linearly travel a distance "T" and rotationally travel an angular value of "A." The sleeve actuator 400 can retain the window sleeve 212 in a first position by retaining the lug 324 in a first position.

Figure 4B:
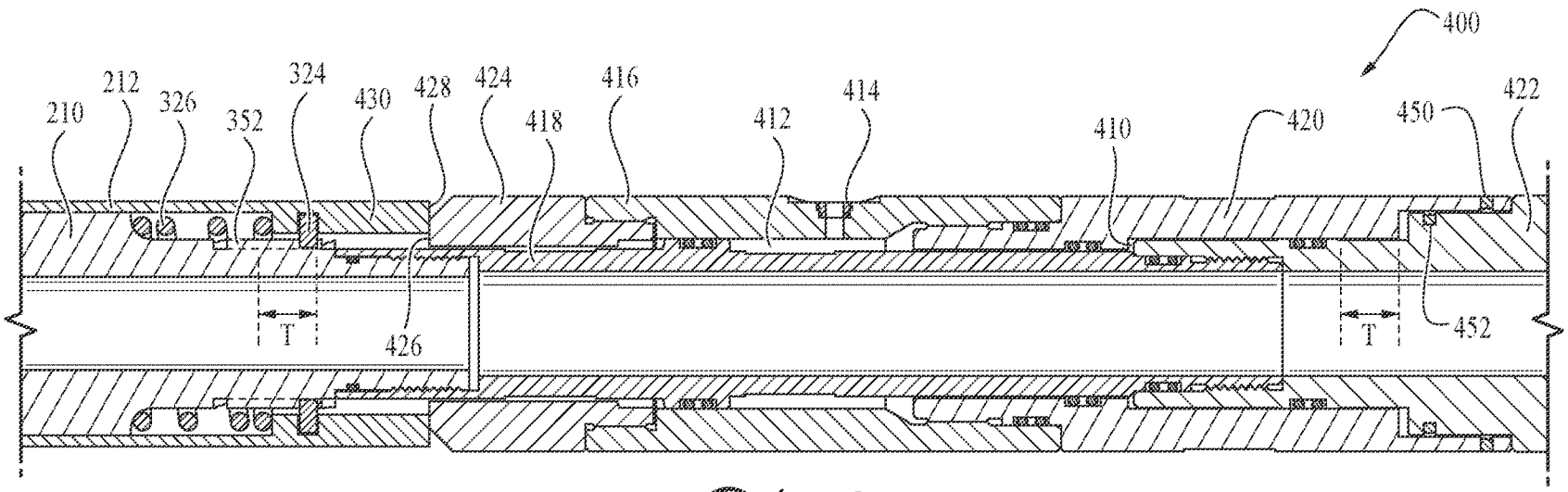

At a predetermined vertical distance from the surface location 128, the hydrostatic pressure within the casing string 108 can generate a differential pressure between the hydrostatic pressure and the atmospheric pressure within the release chamber 412 that ruptures, breaks, and/or removes the fluid stop 414. Turning now to FIG. 4B, a partial cross-sectional view of the sleeve actuator 400 in a second configuration can be described. In some embodiments, the wellbore fluids can flood the release chamber 412 when the fluid stop 414 opens or breaks. The hydrostatic wellbore pressure within the release chamber 412 can create a pressure differential with the activation chamber 410. The pressure differential applied to cross-sectional area of the activation chamber 410, e.g., the inner surface 442 and the outer surface 444, will generate a force in an axial direction to shear the shear pins 450 and push the lower housing 420, upper housing 416, and end ring 424 towards the end sub 422 to a second position also called the release position.

The release position of the sleeve actuator 400 releases or allows the lug 324 and the lug carrier 430 to move relative to the tool mandrel 210. As shown in FIG. 4B, the spring 326 can bias the lug carrier 430 to follow the axial movement of the lower housing 420, upper housing 416, and end ring 424 towards the end sub 422. The spring 326 can urge the lug carrier 430 to remain in contact or abut the end ring 424 of the sleeve actuator 400. As previously described in FIG. 3B, the axial movement of the lug 324 coupled to the lug carrier 430 an axial distance of "T" can angularly translate the window sleeve 212 coupled to the lug carrier 430 an angular distance of "A" to align the one or more windows 254 with one or more magnet rows 260.

Although the sleeve actuator 214 of the selective magnet tool 200 is described as activated by pressure differential in sleeve actuator 300 and activated by hydrostatic pressure in sleeve actuator 400, it is understood that the sleeve actuator 214 can be any type of actuator configured to axially move or allow axial movement of distance "T." For example, the sleeve actuator 214 can be i) a hydraulic system with a volume of fluid and a pump, ii) a single pressure source with a manifold, iii) a gas generator with a manifold, iv) a motor driving a gear system, v) a motor turning a threaded extension, or vi) an electromagnetic extend-retract actuator. In an embodiment, the sleeve actuator 214 comprises a first chamber and a second chamber fluidically connected to a battery powered or surface powered downhole pump that moves the sleeve actuator 214 to a second position by transferring a volume of fluid from a first chamber to a second chamber. In an embodiment, sleeve actuator 214 comprises a pressure source fluidically coupled to a first chamber by a manifold that moves the sleeve actuator 214 to a second position by transferring a volume of fluid or gas to the first chamber. In an embodiment, the sleeve actuator 214 comprises a motor rotationally coupled to a gear system engaged to a threaded surface on a mandrel or extension rod that moves the sleeve actuator 214 to a second position by moving the gear system along the threaded surface. In an embodiment, the sleeve actuator 214 comprises a plurality of electromagnets magnetically coupled to a plurality of permanent magnets on a mandrel that move the sleeve actuator 214 to a second position by moving the permanent magnets relative to the electromagnets.

The selective magnet tool 200 can close the window sleeve 212 to trap or retain the debris and/or particles collected. Some debris may be heavy or comprise a substantial volume that can be dislodged during conveyance to the surface. Closing the window sleeve 212 can retain the collected debris within the radial gap "R" above the top face 272 of the plurality of magnets 216. In some embodiments, the sleeve actuator 214 of the selective magnet tool 200 can configure the magnet tool 200 into three positions: i) a run-in position, ii) an active position, and iii) the run-in position. In some embodiments, the sleeve actuator 214 can return from the second position, e.g., active position, to the first position, e.g., run-in position. Turning back to FIGS. 2C and 2D, the sleeve actuator 214 can retain the window sleeve 212 in a first position, e.g. the run-in position, with the window 254 an angular distance of "A" from the centerline 268. The sleeve actuator 214 can rotate the window 254 an angular distance of "A" to a second configuration with the magnet row 260 aligned with the window 254 as shown in FIG. 2D. The cleanout operation can include conveyance of the cleanout string 124 and pumping fluids through the fluid passage of the cleanout string 124. In some embodiments, the sleeve actuator 214 can be configured to rotate the window 254 an angular distance of "A" in the counter-clockwise direction to cover the radial gap "R." The sleeve actuator 214 can be activated to close or rotate the window 254 to the first position after the cleanout operation. In some embodiments, the sleeve actuator 214 can be configured to rotate the window 254 an angular distance of "A" past the second position (as shown in FIG. 2D) in the clockwise direction to cover the radial gap "R." The sleeve actuator 214 can be activated to close or rotate the window 254 from the second position to a third position, or closed position, after the cleanout operation.

Additional Disclosure

The following are non-limiting, specific embodiments in accordance and with the present disclosure:

A first embodiment, which is a wellbore cleaning tool with a magnetic flux, comprising a tool mandrel generally cylinder in shape with an outer surface, an inner surface, and one or more longitudinal grooves; one or more magnet rows located within the one or more longitudinal grooves; wherein each of the one or more magnet rows produce a magnetic flux; a window sleeve generally cylinder in shape with an outer surface, an inner surface, and one or more longitudinal windows; one or more lugs rotationally coupled to the window sleeve and configured to travel within one or more corresponding helical grooves on the tool mandrel, and wherein the one or more lugs are configured to position the one or more longitudinal windows on the window sleeve relative to the one or more longitudinal grooves on the tool mandrel; and a sleeve actuator comprising a first chamber configured to selectively position the one or more longitudinal windows, via the lug, in a closed position or an open position, wherein the wellbore cleaning tool is configured to not collect ferrous debris, magnetic particles, or combinations thereof in the closed position, and wherein the wellbore cleaning tool is configured to collect ferrous debris, magnetic debris, or combinations thereof in the open position.

A second embodiment, which is the wellbore cleaning tool of the first embodiment, wherein each of the one or more magnet rows comprise a plurality of magnets arranged end to end in a longitudinal row.

A third embodiment, which is the wellbore cleaning tool of any of the first and the second embodiments, wherein each of the plurality of magnets is a geometric shape comprising cubic, rod shape, cylinder shape, cuboid, rectangular bar, torus, sphere, plate shape, button shape, or any combination thereof.

A fourth embodiment, which is the wellbore cleaning tool of any of the first through the third embodiments, further comprising a lug carrier coupled to the window sleeve; and a spring configured to bias the lug carrier from the closed position to the open position.

A fifth embodiment, which is the wellbore cleaning tool of the first through the fourth embodiments, wherein the lug is coupled to lug carrier; wherein the helical groove is configured to rotationally translate the lug an angular distance "A" as the lug linearly translates a longitudinal distance "T"; and wherein the angular distance "A" i) opens or ii) closes the one or more windows on the window sleeve relative to the corresponding one or more magnet rows on the mandrel.

A sixth embodiment, which is the wellbore cleaning tool of any of the first through the fifth embodiments, wherein the sleeve actuator comprises an activation chamber, a fluid port, and a shear device; wherein the activation chamber is defined by an inner surface of a cylinder sleeve, an outer surface of an end sub and an end surface of a lug carrier; wherein the shear device is configured to retain the cylinder sleeve in a first position relative to the end sub and to break in response to a pressure differential within the activation chamber; and wherein the cylinder sleeve is configured to translate axially to a second position in response to breaking of the shear device.

A seventh embodiment, which is the wellbore cleaning tool of any of the first through the sixth embodiment, wherein fluid port is fluidically coupled to i) a fluid passage within the tool mandrel or ii) an annulus between the wellbore cleaning tool and a wellbore.

An eighth embodiment, which is the wellbore cleaning tool of any of the first through the seventh embodiments, wherein the sleeve actuator comprises a release chamber, an activation chamber, and a fluid stop; wherein the activation chamber is defined by an inner surface of a lower housing, an outer surface of a lower mandrel, and an end surface of an end sub; wherein the fluid stop is configured to isolate the release chamber from hydrostatic pressure in a wellbore and retain the sleeve actuator in a first position relative to the mandrel and to break in response to a predetermined value of a pressure differential within the activation chamber; and wherein the end ring coupled to an upper housing is configured to translate axially to a second position in response to removal of the fluid stop.

A ninth embodiment, which is the wellbore cleaning tool of any of the first through the eighth embodiments, wherein the fluid stop is fluidically coupled to i) a fluid passage within the tool mandrel or ii) an annulus between the wellbore cleaning tool and a wellbore.

A tenth embodiment, which is the wellbore cleaning tool of any of the first through the ninth embodiments, wherein a lug carrier is coupled to the end ring or abuts the end ring.

An eleventh embodiment, which is the wellbore cleaning tool of any of the first through the tenth embodiments, wherein the sleeve actuator comprises i) a release chamber with a fluid port, ii) a release chamber, an activation chamber, and a fluid stop, iii) a hydraulic system with a volume of fluid and a pump, iv) a single pressure source with a manifold, v) a gas generator with a manifold, vi) a motor driving a gear system, vii) a motor turning a threaded extension, or viii) an electromagnetic extend-retract actuator, or ix) combinations thereof.

A twelfth embodiment, which a method of cleaning debris from a wellbore with a magnetic cleanout tool, comprising conveying one or more magnetic cleanout tools from a surface location to a target depth within the wellbore; rotating an external sleeve from a first position covering one or more rows of magnets to a second position not covering the one or more rows of magnets; gathering debris with the one or more rows of magnets; and returning the one or more magnetic cleanout tool with the debris to a surface location.

A thirteenth embodiment, which is the method of the twelfth embodiment, further comprising signaling a sleeve actuator from the surface location to rotate the external sleeve from the first position to the second position or the second position to a third position.

A fourteenth embodiment, which is the method of the thirteenth embodiment, wherein the third position covers the one or more rows of magnets.

A fifteenth embodiment, which is the method of any of the thirteenth through the fourteenth embodiment, wherein the third position is the first position.

A sixteenth embodiment, which is the method of any of the thirteenth through the fifteenth embodiment, wherein the third position retains the debris gathered by the rows of magnets.

A seventeenth embodiment, which is the method of any of the thirteenth through the fifteenth embodiment, wherein a first magnetic cleanout tool is configured in the second position at a first target depth; wherein a second magnetic cleanout tool is configured in the second position at a second target depth; and wherein the second target depth and second target depth are i) the same or ii) different.

An eighteenth embodiment, which is a downhole debris collection system, comprising one or more first magnet cleanout tool coupled to a workstring; a debris removal tool coupled to the workstring, wherein the debris removal tool is i) a service packer, ii) a circulation valve, iii) a junk basket, iv) a casing scraper, v) a casing brush, vi) a well screen, vii) a milling shoe, viii) a drill bit, or combinations thereof, wherein each of the one or more first magnet cleanout tools comprises one or more magnet rows coupled to one or more corresponding longitudinal grooves along an outer surface of a tool mandrel, and a sleeve actuator configured to retain a window sleeve in a closed position, and wherein the closed position is configured to block a magnetic flux from the one or more magnet rows; and wherein the sleeve actuator of the first magnet cleanout tool is configured to rotationally translate the window sleeve to a second position, wherein the second position is configured to align one or more windows of the window sleeve with one or more corresponding magnet rows, and wherein the one or more magnet rows are configured to gather debris from a first wellbore location.

A nineteenth embodiment, which is the downhole debris collection system of the eighteenth embodiment, further comprising one or more second magnet cleanout tools coupled to the workstring; and wherein each of the one or more second magnet cleanout tools comprises one or more magnet rows coupled to one or more corresponding longitudinal grooves along the outer surface of a tool mandrel, and a sleeve actuator configured to retain a window sleeve in a closed position, and wherein the closed position is configured to block a magnetic flux from the one or more magnet rows.

A twentieth embodiment, which is the debris collection system of the eighteenth or nineteenth embodiment, wherein the sleeve actuator of the second magnet cleanout tool is configured to rotationally translate the window sleeve to align one or more windows of the window sleeve with one or more corresponding magnet rows, and wherein the one or more magnet rows are configured to gather debris from a second wellbore location.

An twenty-first embodiment, which is a wellbore cleaning tool with a magnetic flux, comprising a tool mandrel generally cylinder in shape with an outer surface, an inner surface, and one or more longitudinal grooves; one or more magnet rows located within the one or more longitudinal grooves; wherein each of the one or more magnet rows produce a magnetic flux; a window sleeve generally cylinder in shape with an outer surface, an inner surface, and one or more longitudinal windows; and a sleeve actuator coupled to the window sleeve and configured to rotate the window sleeve between a closed position and an open position, wherein the wellbore cleaning tool is configured to collect ferrous debris, magnetic debris, or combinations thereof in the open position.

A twenty-second embodiment, which is the wellbore cleaning tool of the twenty-first embodiment, wherein the window sleeve covers the one or more magnet rows in the closed position, wherein the magnetic flux is blocked or substantially blocked by the window sleeve, and wherein the one or more longitudinal windows are out of alignment with the corresponding one or more magnet rows in the closed position.

A twenty-third embodiment, which is the wellbore cleaning tool of the twenty-first or twenty-second embodiment, wherein the one or more windows of the window sleeve are aligned with the one or more magnet rows in the open position, wherein the magnetic flux extends radially outwards through the corresponding one or more longitudinal windows, and wherein the one or more longitudinal windows align with the corresponding one or more magnet rows in the open position.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A tool for cleaning a wellbore, comprising:

a tool mandrel comprising a generally cylindrical shape, an outer surface, an inner surface, and one or more longitudinal grooves;

one or more magnet rows located within the one or more longitudinal grooves;

a window sleeve comprising a generally cylindrical shape, an outer surface, an inner surface, and one or more longitudinal windows; and a sleeve actuator coupled to the window sleeve and configured to rotate the window sleeve from a closed position in which the one or more magnet rows are covered to an open position in which the one or more magnet rows are exposed for collecting magnetic debris.

2. The tool of claim 1, wherein in the closed position, magnetic flux of a magnetic field produced by magnets of the one or more magnet rows is blocked by the window sleeve, and wherein in the closed position, the one or more longitudinal windows are out of alignment with the corresponding one or more magnet rows.

3. The tool of claim 1, wherein in the open position, the one or more longitudinal windows are aligned with the one or more magnet rows, and wherein in the open position, magnetic flux of a magnetic field produced by magnets of the one or more magnet rows passes through the one or more longitudinal windows.

4. The tool of claim 1, wherein each of the one or more magnet rows comprises magnets arranged end-to-end in a longitudinal row, and the magnets comprise any one or any combination of any two or more of a cubic shape, a rod shape, a cylindrical shape, a cuboid shape, a rectangular shape, a torus shape, a spherical shape, a plate shape, and a button shape.

5. The tool of claim 1, further comprising:

one or more lugs rotationally coupled to the window sleeve and configured to travel within one or more corresponding helical grooves on the tool mandrel, wherein the one or more lugs are configured to position the one or more longitudinal windows relative to the one or more longitudinal grooves;

a lug carrier coupled to the window sleeve; and a spring configured to bias the lug carrier.

6. The tool of claim 5, wherein the one or more lugs are coupled to the lug carrier.

7. The tool of claim 1, wherein the sleeve actuator comprises an activation chamber, a fluid port, and a shear device, the activation chamber is defined by an inner surface of a cylindrical sleeve, an outer surface of an end sub, and an end surface of a lug carrier, the shear device is configured to retain the cylindrical sleeve in a first position relative to the end sub, and break in response to a pressure differential within the activation chamber, and the cylindrical sleeve is configured to translate axially to a second position in response to the breaking of the shear device.

8. The tool of claim 7, wherein the fluid port is fluidically coupled to a fluid passage within the tool mandrel or an annulus between the tool and the wellbore.

9. The tool of claim 1, further comprising an end ring and an upper housing, wherein the sleeve actuator comprises a release chamber, an activation chamber, and a fluid stop, the activation chamber is defined by an inner surface of a lower housing, an outer surface of a lower mandrel, and an end surface of an end sub, the fluid stop is configured to isolate the release chamber from hydrostatic pressure in the wellbore, retain the sleeve actuator in a first position, and break in response to a pressure differential within the activation chamber, and the end ring is coupled to the upper housing, and configured to axially translate to a second position in response to removal of the fluid stop.

10. The tool of claim 9, wherein the fluid stop is fluidically coupled to a fluid passage within the tool mandrel or an annulus between the tool and a wellbore, and wherein a lug carrier is coupled to the end ring or abuts the end ring.

11. The tool of claim 1, wherein the sleeve actuator comprises any one or any combination of any two or more of a release chamber, an activation chamber, a fluid stop, a hydraulic system comprising a pump, a pressure source comprising a manifold, a gas generator comprising a manifold, a motor configured to drive a gear system, a motor configured to turn a threaded extension, and an electromagnetic actuator.

12. A method of cleaning debris from a wellbore with a magnetic cleanout tool, comprising:

conveying one or more magnetic cleanout tools from a surface location to a target depth within the wellbore;

rotating an external sleeve from a first position covering one or more rows of magnets to a second position not covering the one or more rows of magnets;

gathering debris with the one or more rows of magnets; and returning the one or more magnetic cleanout tools with the debris to the surface location.

13. The method of claim 12, further comprising:

signaling a sleeve actuator from the surface location to rotate the external sleeve from the first position to the second position or from the second position to a third position.

14. The method of claim 13, wherein in the third position, the sleeve covers the one or more rows of magnets.

15. The method of claim 14, wherein the third position is a closed position.

16. The method of claim 14, wherein in the third position, the debris gathered by the one or more rows of magnets is retained.

17. The method of claim 13, wherein the one or more magnetic cleanout tools comprises a plurality of magnetic cleanout tools, a first magnetic cleanout tool of the plurality of magnetic cleanout tools is configured to be in the second position at a first depth, and a second magnetic cleanout tool of the plurality of magnetic cleanout tools is configured to be in the second position at a second depth.

18. A downhole debris collection system, comprising:

a magnet cleanout tool coupled to a workstring; and a debris removal tool coupled to the workstring, wherein the debris removal tool comprises any one or any combination of any two or more of a service packer, a circulation valve, a junk basket, a casing scraper, a casing brush, a well screen, a milling shoe, and a drill bit, wherein the magnet cleanout tool comprises magnet rows coupled to corresponding longitudinal grooves along an outer surface of a tool mandrel, and a sleeve actuator configured to retain a window sleeve in a closed position, and wherein the sleeve actuator is further configured to rotationally translate the window sleeve to an open position in which one or more windows of the window sleeve are aligned with one or more corresponding magnet rows of the magnet rows for the corresponding magnet rows to gather debris from a wellbore.

19. The downhole debris collection system of claim 18, further comprising one or more other magnet cleanout tools coupled to the workstring.

20. The downhole debris collection system of claim 19, wherein the one or more other magnet cleanout tools comprises one or more other sleeve actuators.

* * * * *